US006033322A

United States Patent [19]

England

[11] Patent Number: 6,033,322

[45] Date of Patent: Mar. 7, 2000

[54] GOLF TOOL

[76] Inventor: Robert L. England, 919 Panferio Rd., Pensacola Beach, Fla. 32561

[21] Appl. No.: 09/102,188

[22] Filed: Jun. 22, 1998

[51] Int. Cl.[7] ..... A63B 57/00

[52] U.S. Cl. ..... 473/408; 473/406

[58] Field of Search ..... 473/406, 408, 473/285, 286; D21/793

[56] References Cited

U.S. PATENT DOCUMENTS

| | | | |
|---|---|---|---|
| 3,233,802 | 2/1966 | Ludwick | 473/406 |
| 3,620,426 | 11/1971 | Hatch | 473/408 |
| 3,866,749 | 2/1975 | Stainer . | |
| 3,895,797 | 7/1975 | Moore . | |
| 4,129,237 | 12/1978 | Grinder . | |
| 4,151,937 | 5/1979 | Jarosh et al. . | |
| 4,315,624 | 2/1982 | Buckman . | |
| 4,358,036 | 11/1982 | Maltais . | |
| 4,530,500 | 7/1985 | Kaymen . | |
| 4,627,621 | 12/1986 | Tate . | |
| 4,960,239 | 10/1990 | Wait . | |
| 5,143,371 | 9/1992 | Strahan . | |
| 5,295,683 | 3/1994 | Tate . | |
| 5,305,999 | 4/1994 | Tate . | |
| 5,341,975 | 8/1994 | Marinescu . | |
| 5,393,052 | 2/1995 | Kennedy | 473/408 |
| 5,517,696 | 5/1996 | Krugler . | |
| 5,733,208 | 3/1998 | Fazekas | 473/408 |

*Primary Examiner*—Steven Wong
*Attorney, Agent, or Firm*—Peter Loffler

[57] ABSTRACT

A golf tool for holding a ball marker and for repairing divots is comprised of a body member having a top, a bottom, a pair of sides, an upper surface and a lower surface with a pair of curved prongs extending from the bottom. A first cavity is located within the upper surface while a slot, either open or closed, is located within the first cavity and may extend through to the lower surface. A portion of the outer periphery of the first cavity and the outer periphery of the slot may be magnetic, or the top surface of the first cavity may be magnetic for holding a ball marker received within the first cavity. A second cavity may be located within the first cavity for ease of ball marker retrieval. A holster is provided for receiving and carrying the golf tool.

36 Claims, 5 Drawing Sheets

GOLF TOOL

BACKGROUND OF THE INVENTION

1. Field of the Invention

The present invention relates to a golf tool capable of removably holding a ball marker as well as repairing divots.

2. Background of the Prior Art

Golf tools that combine a divot repair tool with a ball marker holder are known in the art. U.S. Pat. No. 3,866,749 to Stainer, U.S. Pat. No. 4,151,937 to Jarosh et al., U.S. Pat. No. 4,315,624 to Buckman, U.S. Pat. Nos. 4,627,621, 5,295,683, and 5,305,999 to Tate, and U.S. Pat. No. 4,960,239 to Wait are all examples of such devices. While these devices work with varying levels of efficiency, they suffer from one or more drawbacks. Among these drawbacks is complexity of design which increases the costs of the device. Some devices require a special ball marker, which when lost, renders the device useless in the ball marker storage function. Some devices are inefficient in the method of ball marker storage while others are inefficient to use in divot repair. Some devices are not aesthetically pleasing.

Therefore, there is a need in the art for a golf tool that will hold a variety of ball markers easily and efficiently. Such a device must be relatively easy to use to repair a divot and should be aesthetically pleasing. The device must be of relatively simple design and construction.

SUMMARY OF THE INVENTION

The golf tool of the present invention addresses the aforementioned needs in the art. The present invention provides for a golf tool that holds a variety of ball markers—with or without a stem—and allows a user to efficiently use the device to repair golf course divots. The golf tool is aesthetically pleasing and is of relatively simple design and manufacture. The device is easily transported by a user.

The golf tool of the present invention is comprised of a body member having a top, a bottom, a first side, a second side, an upper surface, and a lower surface. The lower surface, which can be generally convex, can be used to enhance the aesthetic appeal of the device. A pair of curved prongs extend from the bottom of the body member. A pair of nipples are located on the device, one on each of the sides. A first cavity is located within the upper surface and can either extend to the outer periphery of the body member or can terminate shy of the outer periphery. A slot, which can be open or closed depending on the nature of the first cavity is located within the first cavity. The slot which may be bulbed can extend through to the lower surface. A magnetic portion extends along a portion of the outer periphery of the first cavity and the outer periphery of the slot. Alternately, the upper surface of the first cavity is magnetic. An optional second cavity is located within the first cavity and has a wall that may but not be diagonally disposed relative to the top surface of the first cavity. A depression is located on the upper surface.

A ball marker, with or without a stem, is held within the first cavity with the stem (if used) of the ball marker being received within the slot. The magnetic portion or the magnetic top surface of the first cavity holds the ball marker in place. A pocket formed between the first cavity and the upper surface assist in securing the ball marker in place. Removal of the ball marker is accomplished by sliding the ball marker out of the open slot, or by pressing a portion of the ball marker into the second cavity and lifting the ball marker out therefrom. The divot tool is highly efficient due to the curved nature of the prongs acting in similar fashion to a shovel. The depression allows a user to firmly grasp the golf tool and move sufficient earth material to quickly repair the divot. A holster is used to easily transport the device about a golf course and makes one hand removal of the golf tool therefrom simple and straightforward. Furthermore, in order to obtain the ball marker from the golf tool, the tool need not be removed from the holster. The holster can be clipped to a user's pants or belt.

BRIEF DESCRIPTION OF THE DRAWINGS

Similar reference numerals refer to similar parts throughout the several views of the drawings.

DESCRIPTION OF THE PREFERRED EMBODIMENT

Figure 2:
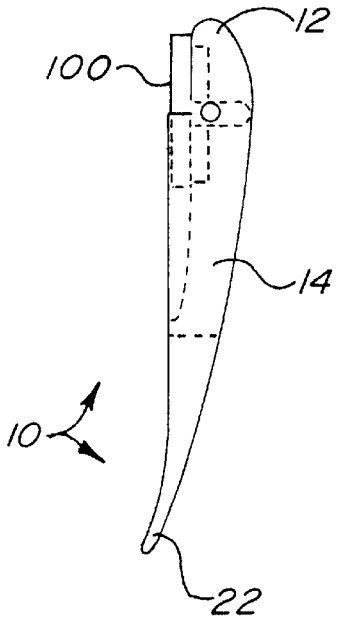
FIG. 2 is a side elevation view, partially sectioned, of the golf tool with the ball marker received within the first cavity.
Figure 3:
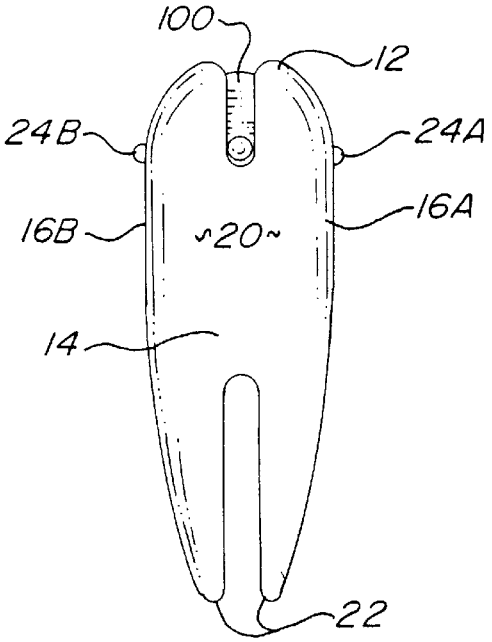
FIG. 3 is a rear elevation view of the golf tool.
Figure 4:
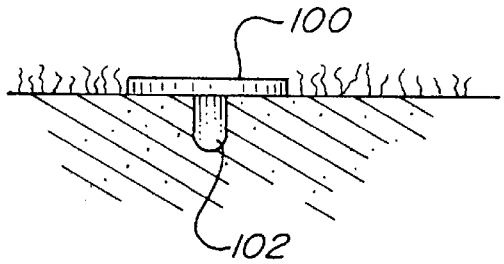
FIG. 4 is a side elevation view of the ball marker positioned on the ground.
Figure 5:
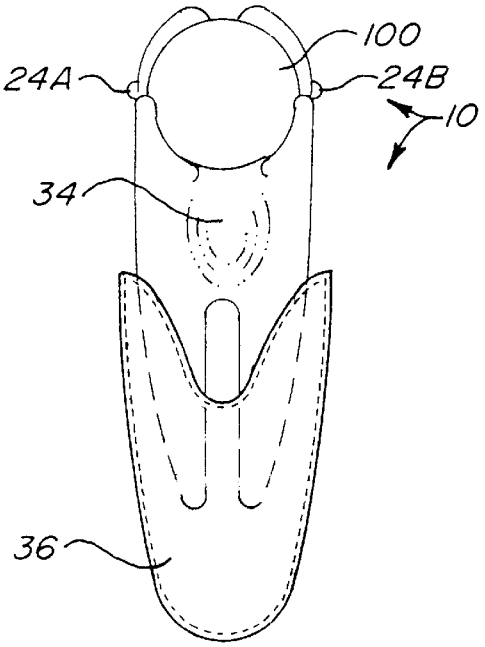
FIG. 5 is a front elevation view of the golf tool received within the holster.
Figure 6:
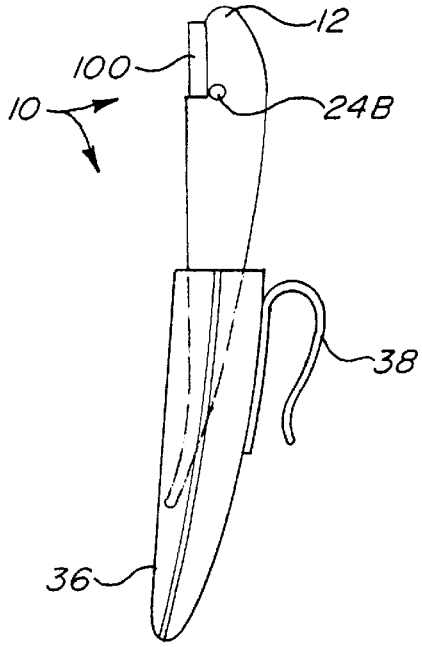
FIG. 6 is a side elevation view of FIG. 5.
Figure 7:
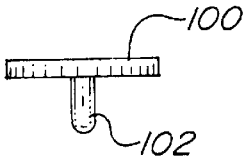
FIG. 7 is a side elevation view of a ball marker utilizable with the golf tool of the present invention.
Figure 8:
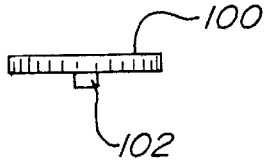
FIG. 8 is a side elevation view of an alternate ball marker utilizable with the golf tool.
Figure 9:
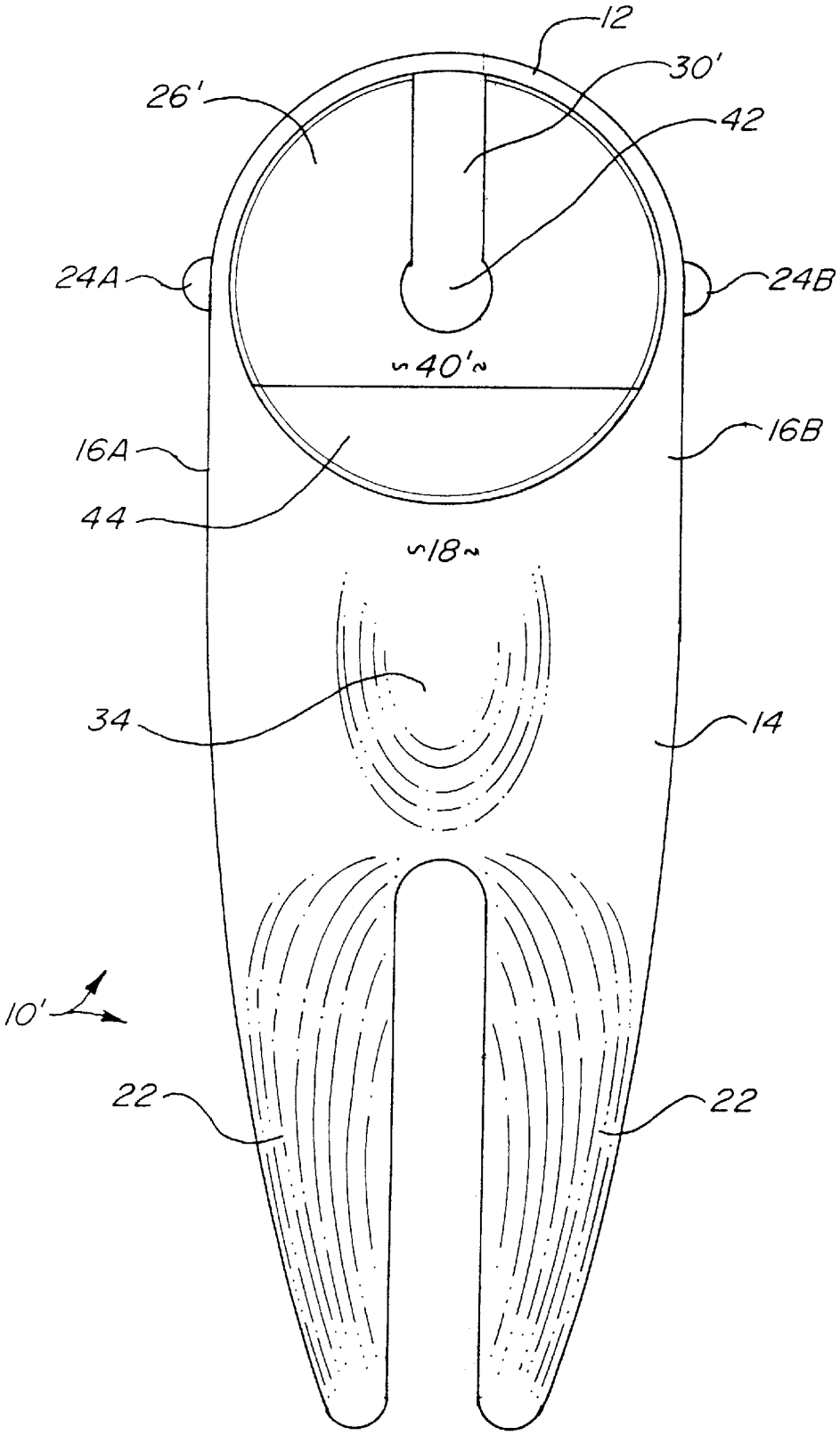
FIG. 9 is a front elevation view of an alternate embodiment of the golf tool of the present invention.
Figure 10:
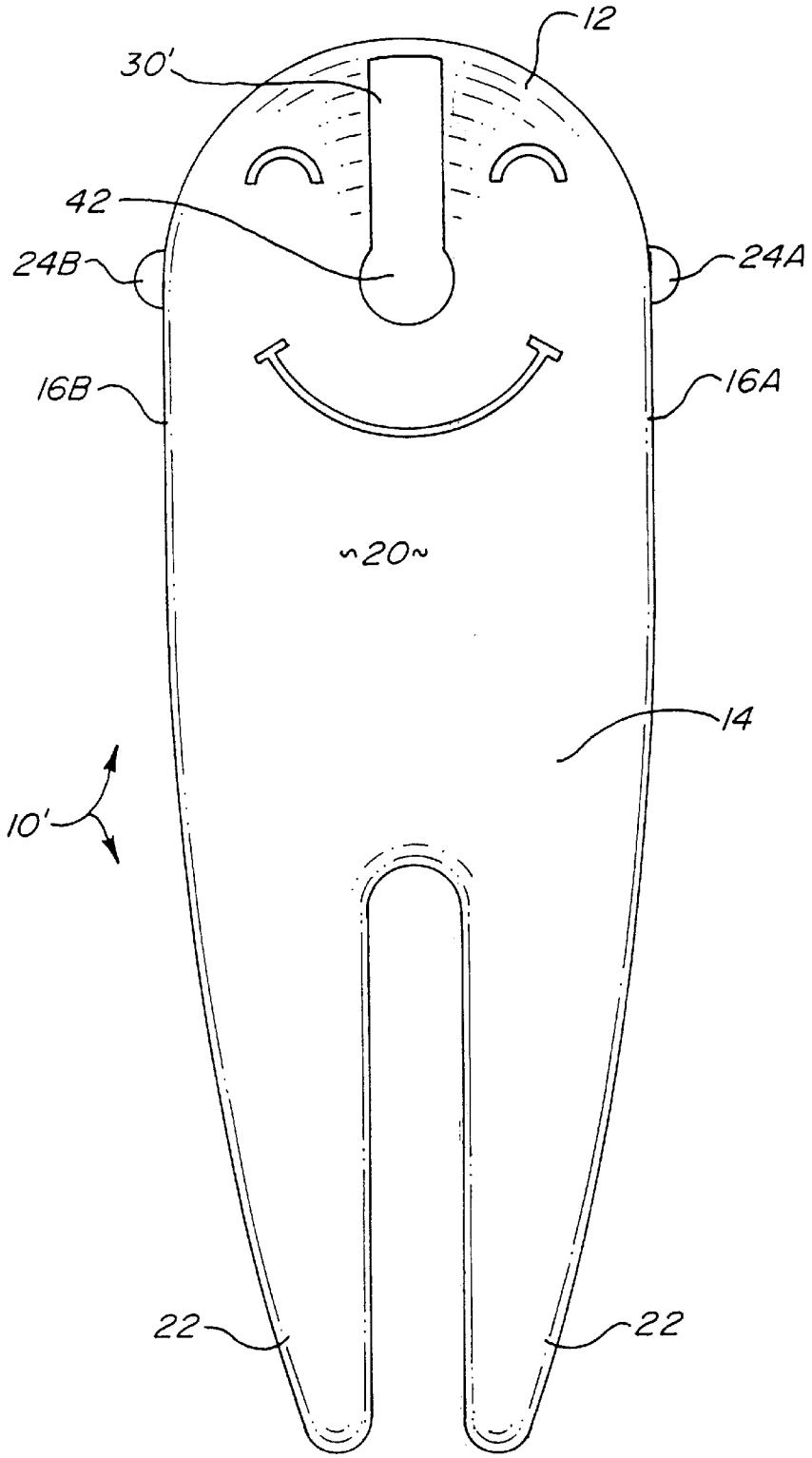
FIG. 10 is a rear elevation view of the alternate embodiment of the golf tool.
Figure 11:
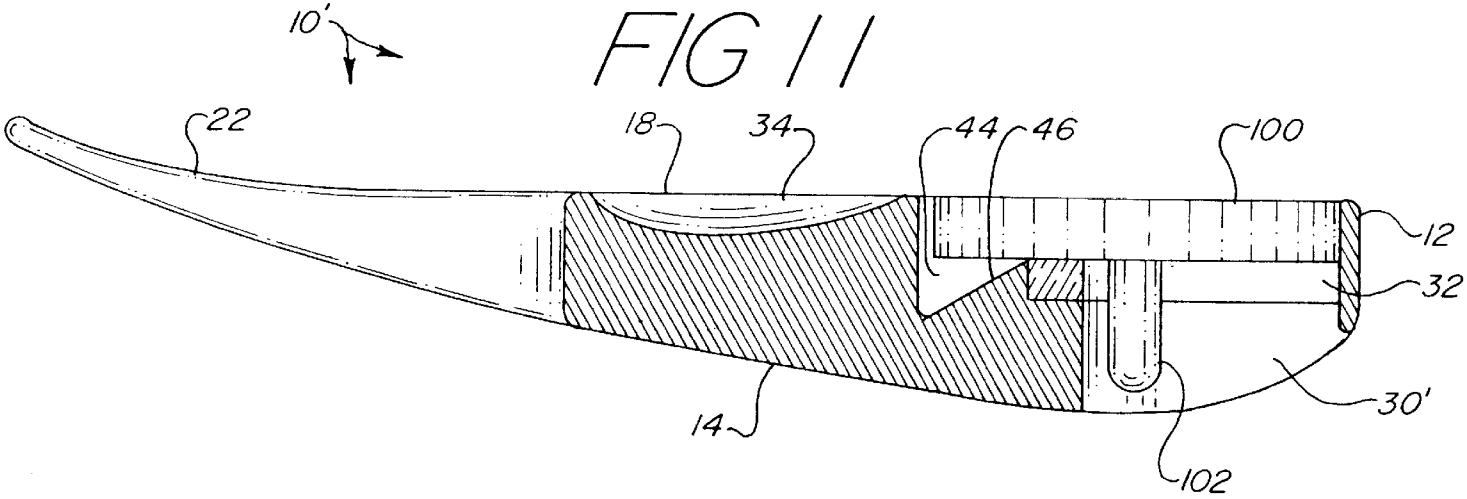
FIGS. 11 and 12 illustrate removal of the ball marker from the golf tool when a second cavity is utilized.
Figure 12:
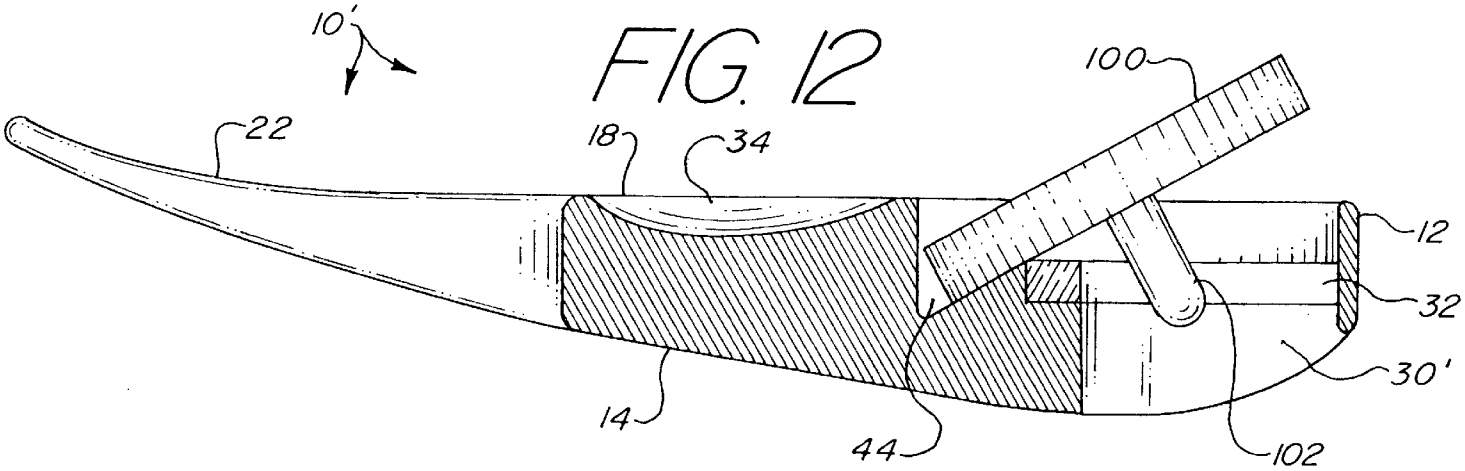

Referring now to the drawings, it is seen that the golf tool of the present invention, generally denoted by reference numeral 10, is comprised of a body member having a top 12, a bottom 14, a first side 16*a*, a second side 16*b*, an upper surface 18 and a lower surface 20. A pair of generally coextensive prongs 22 extend from the bottom 14 of the body member. As best seen in FIG. 2, at least a portion of the prongs 22 are curved and the entire lower surface 20 in combination with the prongs 22 is generally convex (concave with respect to the upper surface 18). As seen in FIG. 10, the lower surface 20 of the golf tool 10 can be used for ornamental purposes.

Figure 1:
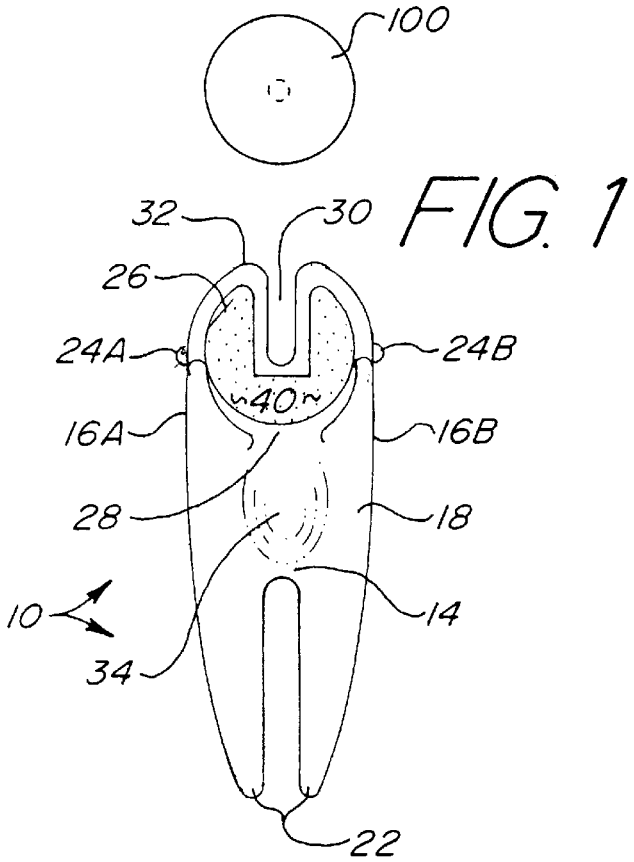
FIG. 1 is a front elevation view of the golf tool of the present invention with the ball marker removed.

A first nipple 24*a* is located on the first side 16*a* while a second nipple 24*b* is located on the second side 16*b*. A cavity 26 is located within the upper surface 18. As best seen in FIGS. 1 and 2, the cavity 26 is located proximate the top 12 of the golf tool 10 and extend across to either side 16*a* and 16*b*. At least a portion of the cavity 26 is generally arcuate and a portion of the cavity 26 forms a pocket 28 with the upper surface 18 of the golf tool 10. A slot 30 is located within the cavity 26 and may but need not extend through to the lower surface 20. A magnetic portion 32 extends along a portion of the outer periphery of the cavity 26 and along the outer periphery of the slot 30, with the area of the magnetic portion 32 at the mouth of the slot 30 being rounded. A depression 34 is located within the upper surface 20 in spaced apart relation to the cavity 26. The golf tool 10 may be received within a holster 36, the holster 36 being adapted (by way of a clip 38 or other similar implement) to be easily carried by a golfer.

In order to utilize the golf tool of the present invention, the stem 102 of a ball marker 100 is received within the slot 30 such that the face of the ball marker 100 rests upon the top surface 40 of the cavity 26 with a portion of the ball marker 100 resting within the pocket 28. The rounded nature of the mouth of the slot 26 helps guide the ball marker 100 into place. Advantageously, the ball marker 100 will not extend beyond the outer periphery of the device 10. As the ball marker 100 is metallic, the magnetic portion 32 helps retain the ball marker 100 in proper position. The entire device 10 is stored within the holster 36 and transported as desired. When use of the golf tool 10 is desired, it is retrieved from the holster 36, with the nipples 24*a* and 24*b* assisting in the retrieval of the device 10. If the ball marker 100 is needed, it is simply slid out of the slot 30 (without the need to remove the golf tool 10 from the holster 36) and used as needed. If divot repair is needed, the user grasps the device 10—the depression 34 giving the user a firm grip on the device 10—and the divot is repaired using the prongs 22. The curved nature of the prongs 22 allow the device 10 to act like a shovel and move a relatively large amount of dirt in order to effect a timely and efficient repair of the divot.

As seen in FIGS. 9–12, in an alternate embodiment of the golf tool 10' a generally round first cavity 26' is located within the upper surface 18 without extending to the outer periphery of the body member. The top surface 40' of the first cavity 26' may but need not be magnetic. A closed slot 30' is disposed within the first cavity 26' and may have a bulbed portion 42. Again, this slot 30' may but need not extend through to the lower surface 20. A second cavity 44 is located within the first cavity 26' and has a wall 46 that may but need not be disposed diagonally to the top surface 40' of the first cavity 26'. In order to use this alternate embodiment of the golf tool 10' the ball marker 100 is inserted into the first cavity 26' such that the stem 102 is received within the slot 26' (and bulbed portion 42 if used). In order to remove the ball marker 100, force is applied to the ball marker 100 above the second cavity 44 pushing a portion of the ball marker 100 into the second cavity 44. The user can now easily grasp the ball marker 100. In all other respects, the alternate embodiment of the golf tool 10' is identical to the first embodiment and elements of the first embodiment and the second embodiment (second cavity, magnetic outer periphery, etc.,) may be interchanged between the two embodiments.

While the invention has been particularly shown and described with reference to an embodiment thereof, it will be appreciated by those skilled in the art that various changes in form and detail may be made without departing from the spirit and scope of the invention.

I claim:

1. A golf tool comprising:

a body member having a top, a bottom, a first side, a second side, an upper surface, and a lower surface;

a pair of prongs extending from the bottom;

a first cavity, having a first outer periphery and a top surface, located within the upper surface;

a open slot, having a second outer periphery, located within the first cavity; and a magnetic portion extending along a portion of the first outer periphery and along the second outer periphery.

2. The golf tool as in claim 1 further comprising:

a first nipple located on the first side; and a second nipple located on the second side.

3. The golf tool as in claim 1 wherein each of the pair of prongs is curved.

4. The golf tool as in claim 1 wherein at least a portion of the first cavity is arcuate.

5. The golf tool as in claim 1 wherein the top surface is magnetic.

6. The golf tool as in claim 1 further comprising a pocket formed between a top surface of the first cavity and the upper surface.

7. The golf tool as in claim 1 further comprising a depression located within the upper surface.

8. The golf tool as in claim 1 wherein the lower surface is generally convex.

9. The golf tool as in claim 1 wherein the slot is closed.

10. The golf tool as in claim 1 wherein a portion of the slot is bulbed.

11. The golf tool as in claim 1 further comprising a second cavity located within the first cavity.

12. The golf tool as in claim 11 wherein a wall of the second cavity is disposed diagonally to a top surface of the first cavity.

13. The golf tool as on claim 1 further comprising a holster for receiving the golf tool.

14. A golf tool comprising:

a body member having a top, a bottom, a first side, a second side, an upper surface, and a lower surface;

a pair of prongs extending from the bottom;

a first cavity, having a magnetic top surface, located within the upper surface;

a second cavity located within the first cavity; and a slot located within the cavity.

15. The golf tool as in claim 14 further comprising:

a first nipple located on the first side; and a second nipple located on the second side.

16. The golf tool as in claim 14 wherein each of the pair of prongs is curved.

17. The golf tool as in claim 16 wherein the first cavity is generally round.

18. The golf tool as in claim 14 further comprising a depression located within the upper surface.

19. The golf tool as in claim 14 wherein the lower surface is generally convex.

20. The golf tool as in claim 14 wherein a portion of the slot is bulbed.

21. The golf tool as in claim 14 wherein the slot is closed.

22. The golf tool as in claim 14 wherein a wall of the second cavity is disposed diagonally to a top surface of the first cavity.

23. The golf tool as on claim 14 further comprising a holster for receiving the golf tool.

24. A golf tool comprising:

a body member having a top, a bottom, a first side, a second side, an upper surface, and a lower surface;

a pair of prongs extending from the bottom;

a first cavity, having a first outer periphery and a top surface, located within the upper surface;

a slot, having a second outer periphery, located within the first cavity;

a second cavity located within the first cavity; and a magnetic portion extending along a portion of the first outer periphery and along the second outer periphery.

25. The golf tool as in claim 24 further comprising:

a first nipple located on the first side; and a second nipple located on the second side.

26. The golf tool as in claim 24 wherein each of the pair of prongs is curved.

27. The golf tool as in claim 24 wherein at least a portion of the first cavity is arcuate.

28. The golf tool as in claim 24 wherein the top surface is magnetic.

29. The golf tool as in claim 24 further comprising a pocket formed between a top surface of the first cavity and the upper surface.

30. The golf tool as in claim 24 further comprising a depression located within the upper surface.

31. The golf tool as in claim 24 wherein the lower surface is generally convex.

32. The golf tool as in claim 24 wherein the slot is open.

33. The golf tool as in claim 24 wherein the slot is closed.

34. The golf tool as in claim 24 wherein a portion of the slot is bulbed.

35. The golf tool as in claim 24 wherein a wall of the second cavity is disposed diagonally to a top surface of the first cavity.

36. The golf tool as on claim 24 further comprising a holster for receiving the golf tool.

* * * * *